US009772081B2

(12) United States Patent
Leitow et al.

(10) Patent No.: US 9,772,081 B2
(45) Date of Patent: Sep. 26, 2017

(54) LIGHTING DEVICE FOR VEHICLES

(71) Applicant: Hella KGaA Hueck & Co., Lippstadt (DE)

(72) Inventors: Marc Leitow, Lippstadt (DE); Paula Madrid Fernandez, Lippstadt (DE); Hans-Jürgen Nickel, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 141 days.

(21) Appl. No.: 14/603,858

(22) Filed: Jan. 23, 2015

(65) Prior Publication Data

US 2015/0211705 A1 Jul. 30, 2015

(30) Foreign Application Priority Data

Jan. 27, 2014 (DE) ..... 10 2014 100 904

(51) Int. Cl.

| | |
|---|---|
| ***F21V 11/00*** | (2015.01) |
| ***F21S 8/10*** | (2006.01) |
| *F21W 101/10* | (2006.01) |
| *F21Y 101/00* | (2016.01) |
| *F21Y 115/10* | (2016.01) |

(52) U.S. Cl.

CPC ..... *F21S 48/1225* (2013.01); *F21S 48/1154* (2013.01); *F21S 48/1258* (2013.01); *F21W 2101/10* (2013.01); *F21Y 2101/00* (2013.01); *F21Y 2115/10* (2016.08)

(58) Field of Classification Search

CPC ..... F21S 48/1225; F21S 48/1154; F21S 48/1258; F21S 48/00; F21W 2101/10; F21Y 2101/10; F21Y 2101/02

USPC ..... 362/510, 507, 509, 459, 539, 249.02, 362/311.02, 230–235, 84

See application file for complete search history.

(56) References Cited

U.S. PATENT DOCUMENTS

| | | | | |
|---|---|---|---|---|
| 5,014,173 A * | 5/1991 | Lindae | ..... | F21S 48/1258 362/309 |
| 7,175,323 B2 * | 2/2007 | Bucher | ..... | F21S 48/145 362/293 |
| 7,455,439 B2 * | 11/2008 | Albou | ..... | F21S 48/145 362/297 |

(Continued)

FOREIGN PATENT DOCUMENTS

| | | |
|---|---|---|
| DE | 102010027322 A1 | 1/2012 |
| EP | 0221416 B1 | 9/1995 |

*Primary Examiner* — Elmito Breval
*Assistant Examiner* — Jessica M Apenteng
(74) *Attorney, Agent, or Firm* — Husch Blackwell LLP

(57) ABSTRACT

A lighting device for vehicles with a semiconductor-based light source and an optical unit having an imaging device for producing a predetermined light distribution and having an optical element arranged between the semiconductor-based light source and the imaging device. The optical element has a back side facing the semiconductor-based light source and has a front side facing the imaging device. The optical element is formed as a color correction element which has a color correction-free partial surface area through which a firstly emitted partial light beam of the semiconductor-based light source passes and has a color correction-affected partial surface area through which the secondly emitted partial light beam of the semiconductor-based light source passes in a border angle area.

12 Claims, 2 Drawing Sheets

(56) References Cited

U.S. PATENT DOCUMENTS

| | | | | |
|---|---|---|---|---|
| 8,070,339 | B2 * | 12/2011 | Koike | F21S 48/1159 362/296.01 |
| 2008/0170409 | A1 * | 7/2008 | Tendo | F21S 48/1283 362/538 |
| 2009/0257240 | A1 | 10/2009 | Koike | |

* cited by examiner

LIGHTING DEVICE FOR VEHICLES

CROSS REFERENCE

This application claims priority to German Application No. 10 2014 1007904.5, filed Jan. 27, 2014, which is hereby incorporated by reference.

FIELD OF TECHNOLOGY

The invention relates to a lighting device for vehicles with a semiconductor-based light source and an optical unit having an imaging device for producing a predetermined light distribution and having an optical element arranged between the semiconductor-based light source and the imaging device, wherein the optical element has a back side facing the semiconductor-based light source and has a front side facing the imaging device.

BACKGROUND

From DE 10 2010 027 322 A 1, an illumination device for vehicles is known, which comprises a semiconductor-based light source and an imaging device by means of which a predetermined light distribution is produced. Since the semiconductor-based light source consists of several LED chips that are arranged like a matrix, the individual LED light sources are mapped to spots of light, between which an undesirable gap is formed. In order to avoid such undesirable gaps in the light distribution, an optical element is arranged between the light source and the imaging device having a plurality of refractive micro optical components. These micro optical components are arranged distributed over the entire surface of the optical element, so that a total homogenization of the light distribution is affected. The problem of color fringes at a light-dark border in the light distribution as a result of chromatic aberration is not addressed.

From EP O 221 416 B1, a lighting device for a vehicle is known which provides a lens-shaped optical element for the prevention of undesirable color fringes of the light-dark boundary of a light distribution, which has a plurality of aspherical partial surfaces on its side facing away from the light source.

The disadvantage of this, however, is that the formation of these aspherical partial surfaces is relatively expensive.

SUMMARY OF THE INVENTION

The object of the present invention is therefore to provide a lighting device for vehicles in such a way that the appearance of color fringes in a light distribution is prevented in a simple and inexpensive way.

To achieve this object, the invention is characterized in that the optical element is formed as a color correcting element that has a color correction-free partial surface area through which a firstly emitted partial light beam of the semiconductor-based light source passes and has a color correction-affected partial surface area through which the secondly emitted partial light beam of the semiconductor-based light source passes in a border angle area.

According to the invention, an arranged optical element is configured as a color correction element between a semiconductor-based light source and an imaging device which prevents the occurrence of a color fringe in a light distribution. The color correction element has, on the one hand, a color correction-free partial surface area which does not affect color correcting on a first partial light beam passing through the same. The first partial light beam is thus virtually not affected since the color correction-free partial surface area is preferably formed transparent, glass clear and colorless. Thus, there is no significant deterioration of the light values of the first partial light beam. Further, the color correction element has a color correction-affected partial surface area, by means of which a second partial light beam is influenced so that no color fringing occurs in the light distribution. The color correction-affected partial surface area is preferably arranged relative to the light source so that only beams of light responsible for the color fringe in a border angle area of the light beams exiting from the light source pass through the color correction-affected partial surface area. By means of the color correction-affected partial surface area, there is a mixing of the light beams of different light color or a correction of the same, so that the color correction in the vicinity of the originating site is thus corrected or remedied in the main direction of the beam before the optical element.

According to the invention, there is a selective color correction of the semiconductor-based light source, in which the luminous flux of the semiconductor-based light source is not significantly reduced.

The color correction element acts as a kind of filter which corrects the light color of the light source before it enters the optical element. An intensification of the chromatic aberration in the optical element can thus be counteracted.

According to a preferred embodiment of the invention, the color correction-affected partial surface area of the color correction element is arranged both on a back side facing away from the semiconductor light source as well as on a front side facing toward the semiconductor-based light source. The color correction-affected partial surface area of the color correction element is produced and positioned by the same surface treatment so that only rays of light emitted from the light source in an border angle area or border solid angle area of the color correction-affected partial surface area are captured.

According to another embodiment of the invention, the color correction-affected partial surface area extends on a rear side of the color correction element in both an upper as well as a lower section, whereby the color correction-free partial surface area is arranged only by a horizontal strip between the upper and the lower section of the color correction-affected partial surface area. The semiconductor-based light source is arranged in the height of this horizontal strip. Since the color correction element is preferably located near the light source, the color correction-free first partial light beam contributes to a predominant part of the output luminous flux on the optical element. The color correction-affected second partial light beam is formed only by border angle light rays that contribute to a relatively small contribution to the output luminous flux in the optical element.

In a further development of the invention, the color correction partial surface area is produced by roughening a surface of the color correction element. This rough surface structure allows a scattering of light rays of the second partial light beam. There is a thorough mixing of the light beams of different colors, so that the second partial light beam emerges with a neutral white light color from the color correction element.

According to an embodiment of the invention, the color correction element consists of a transparent plastic. Due to the roughening of the surface in the color correction-affected partial surface area, local areas arise which have a comparatively lower transparency.

In a further embodiment of the invention, the color correction element has a wall thickness in a range between 1 mm and 5 mm. The light losses of the first partial light beam are thereby advantageously minimized.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
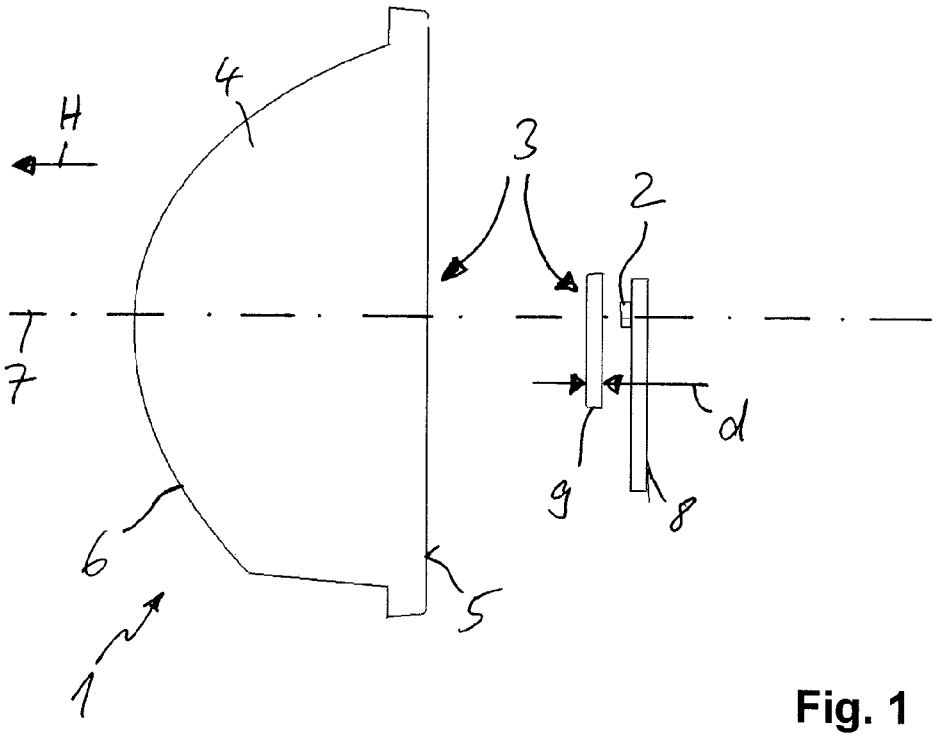
FIG. 1 is a vertical section of a lighting device.

An inventive lighting device 1 for generating a predetermined light distribution, for example, low beam distribution, may be used as a headlight. The lighting device 1 comprises essentially a semiconductor-based light source 2 and an optical unit 3 arranged in the main direction of the beam H before the same.

The optical unit 3 consists firstly of an imaging device 4, by means of which light emitted from light source 2 corresponding to the predetermined light distribution is deflected, for example with a low beam distribution, high beam distribution or similar. The imaging device 4 is formed as a lens having a planar light entrance surface 5 as well as an aspherical light-emitting surface 6. The planar light entry surface 5 is arranged perpendicular to an optical axis 7 of the lens 4 and the light source 2. The aspherical light exit surface 6 is arranged in the main direction of the beam H in front of the planar light entry surface 5.

The semiconductor-based light source 2 is preferably formed as an LED light source that can consist of a 1-chip LED light source or distributed as a matrix on a multi-chip LED light source. The LED light source 2 is arranged on a carrier 8.

For the other, the optical unit 3 has a color correction element 9 that is arranged between the light source 2 and the lens 4. By means of the color correction element 9, an undesirable color fringe is prevented in the light distribution of the lighting device. The color correction element 9 is plate-shaped and is located near the light source 2. The color correction element has both, on the one hand, back side 10 facing the light source 2 as well as front side 11 facing the lens 4, and on the other hand, a color correction-free partial surface area 12 and a color correction-affected area 13.

As is better seen from FIGS. 3 to 6, the color correction-affected partial surface area 13 extends on the back side in an upper section 14 and in a lower section 15, whereby the color correction-free partial surface area 12 extends as a horizontal strip between the sections 14 and 15. As is apparent from FIGS. 1 and 2, the semiconductor-based light source 2 is arranged displaced horizontally to the horizontal strip 16. The horizontal strip 16 has a width b which is equal to or greater than a vertical dimension of the light source 2.

Further, the color correction element 9 has the color correction-free partial surface area 12 on the front side 11 in an upper section 17 and the color correction-affected partial surface area 13 in a lower section 18. An upper edge of the lower section 18 is arranged vertically downwardly displaced to an upper edge 20 of the lower section 15 arranged on the back side 10. This offset can, for example, amount to 0.5 mm.

The color correction element 9 is manufactured from a transparent, preferably glass-clear and colorless plastic material. The color correction-free partial surface area 12 is thus designed to be transparent and to let the light through with relatively low light loss.

The color correction element 9 may have a wall thickness d in a range from 1 mm to 5 mm, preferably 1 mm to 1.5 mm.

The color correction-affected partial surface area 13 has been manufactured through surface treatment. The relevant sections 14, 15 and 18 are formed by roughening the surface of the color correction element 9. The roughness of these sections may be in a μm range.

The color correction element 9 is thus arranged to the light source 2 so that a relatively large first partial light beam L1 passes through the color correction-free partial surface area 12 via the refraction on the back side 10 and on the front side 11 thereof, without substantially reducing the luminous flux.

A second partial light beam L2 passes through the color correction-affected partial surface area 13, which essentially consists of emitted light beams of the light source 2 in a border angle area. The light beams of the second partial beam L2 are thus emitted at a relatively large opening angle compared to the first partial light beam L1, as can be seen in particular from FIG. 2.

The second partial light beam L2 is already mixed within the color correction element 9 due to the scattering surface structure of the color correction element 9 in the color correction-affected partial surface area 13 so that a color correction occurs in the boundary area of light beams emitted from the light source 2. The second partial light beam thus also exits from the color correction element 9, like the first partial light beam L2, and then itself enters at the planar light input surface 5 of the lens 4.

According to an alternative embodiment not shown, the color correction-affected partial surface area 13 may also be arranged only on the back side 10 or on the front side 11 of the color correction element 9. To achieve the equal mixing of the second partial light beam L2, the roughness here must be larger compared to the embodiment described above.

The color correction element 9 is constructed as plate-shaped and has depressed retaining brackets 21 on opposite sides, each having a bore 22 for fastening the color correction element 9 to the carrier 8 of the LED light source 2. Preferably, the color correction element 9 is connected with the constructed carrier 8 as a printed circuit board by screwing or by riveting.

Figure 2:
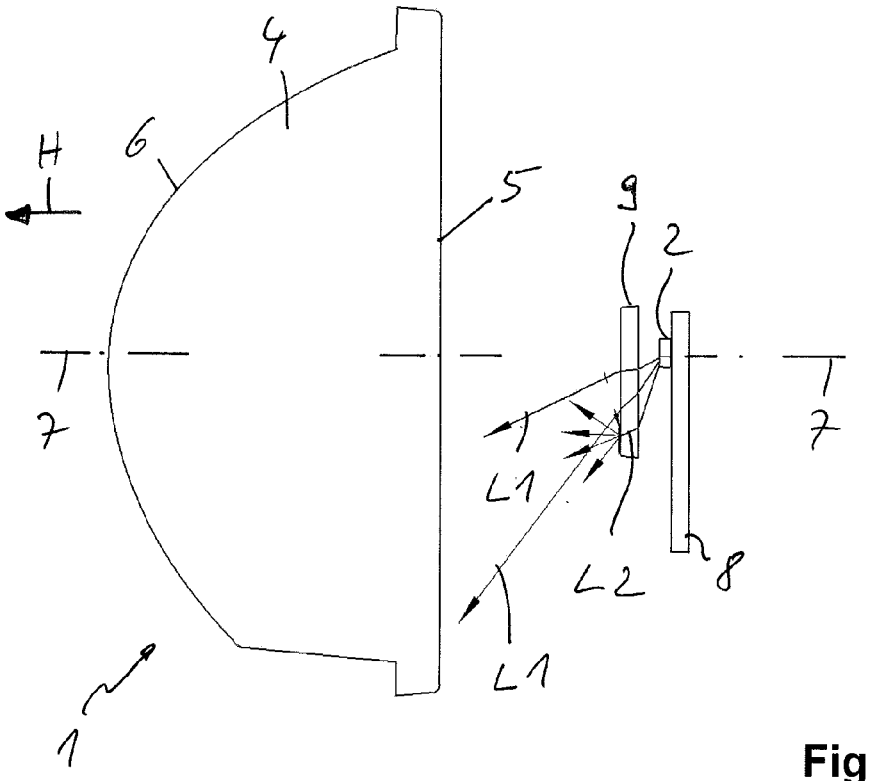
FIG. 2 is a vertical section of the lighting device with marked light rays.
Figure 3:
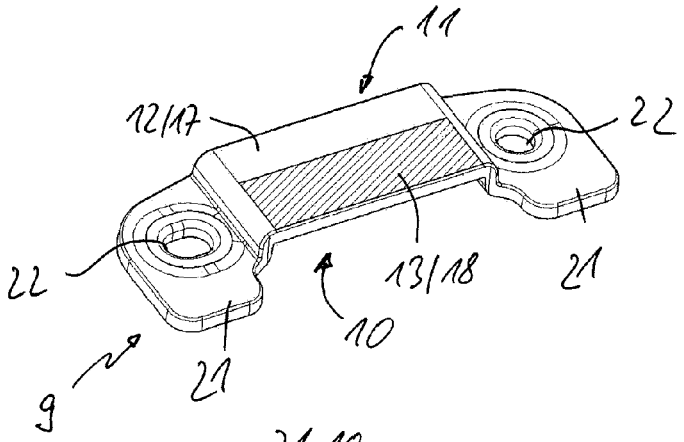
FIG. 3 is a front perspective view of a color correction element of the lighting device.
Figure 4:
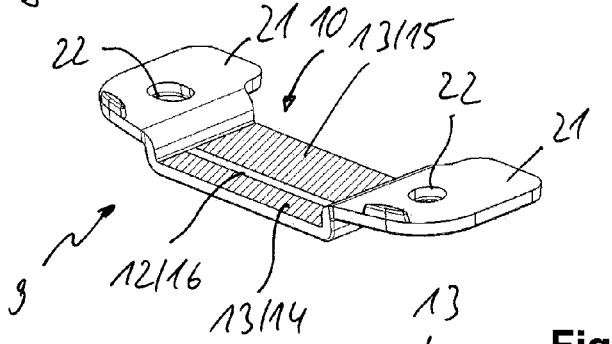
FIG. 4 is a rear perspective view of the color correction element.
Figure 5:
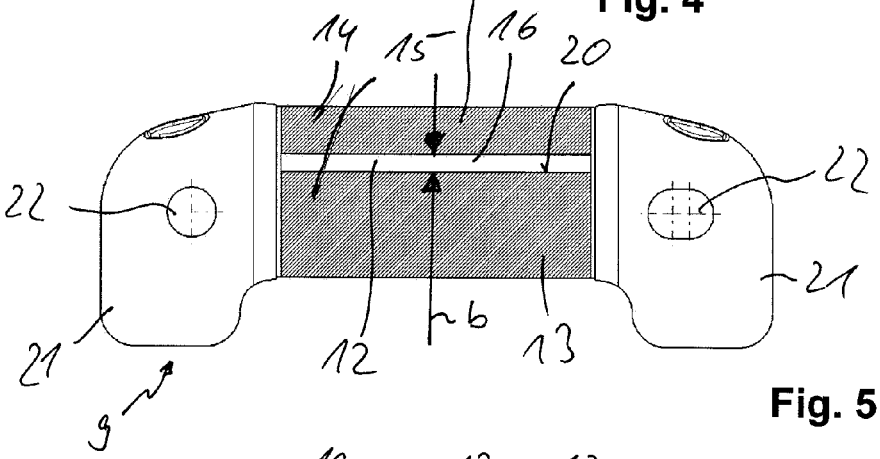
FIG. 5 is a rear view of the color correction element and FIG. 6 is a front view of the color correction element.
Figure 6:
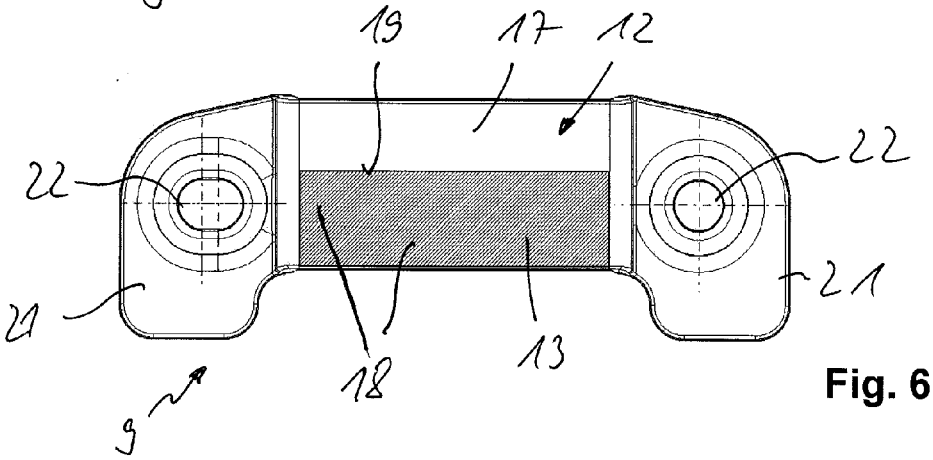

As can be seen from FIGS. 1 and 2, the color correction element 9 is arranged in a small distance to the LED light source 2. This distance is dependent on the development of heat of the LED light source 2. Preferably, the color correction element 9 is arranged close to the LED light source 2 so that no impairment of the color correction element 9 occurs due to thermal stress.

REFERENCE NUMBER LIST

1 Lighting device
2 Light source
3 Optical unit
4 Imaging device

5 Light entry surface
6 Light-emitting surface
7 Optical axis
8 Carrier
9 Color correction element
10 Rear side
11 Front side
12 Color correction-free partial surface area
13 Color correction-affected partial surface area
14 Upper section
15 Lower section
16 Horizontal strip
17 Upper section
18 Lower section
19 Upper edge
20 Lower edge
L1 First partial light beam
L2 Second partial light beam
H Main direction of beam
d Wall thickness
b Width

The invention claimed is:

1. A lighting device for vehicles comprising:
a semiconductor-based light source;
an optical unit having an imaging device and a color correction element, said imaging device for producing a predetermined light distribution, and said color correction element arranged between the semiconductor-based light source and the imaging device,
wherein the color correction element has a back side facing the semiconductor-based light source and has a front side facing the imaging device,
wherein the front side of the color correction element consists of a transparent color correction-free partial surface area through which a firstly emitted partial light beam of the semiconductor-based light source passes, and a color correction-affected partial surface area through which a secondly emitted partial light beam of the semiconductor-based light source passes in a border angle area, and
wherein the color correction-affected partial surface is less transparent than the color correction-free partial surface.

2. The lighting device according to claim 1, wherein the color correction-affected partial surface area of the color correction element is designed in such a way that the secondly emitted partial light beam emerges with a neutral white light color from the color correction element.

3. The lighting device according to claim 1, wherein the color correction-affected partial surface area of the color correction element is arranged both on the back side as well as on the front side of the color correction element.

4. The lighting device according to claim 1 wherein the color correction-affected partial surface area extends to the back side of the color correction element in an upper section and in a lower section, between which extends a horizontal strip of the color correction-free partial surface area, and that the semiconductor-based light source is arranged horizontally offset to the horizontal strip.

5. The lighting device according to claim 1 wherein on the front side of the color correction element, the color correction-affected partial surface area extends in a lower section and the color correction-free partial surface area extends in an upper section, wherein an upper edge of the color correction-affected partial surface area runs offset vertically downwards to an upper edge of the lower section of the color correction-free partial surface area on the back side.

6. The lighting device according to claim 1 wherein the color correction element is plate-shaped with a depressed retaining bracket for attachment to a carrier of the semiconductor-based light source.

7. The lighting device according to claim 1 wherein the color correction element is arranged near the semiconductor-based light source.

8. The lighting device according to claim 1 wherein the color correction-affected partial surface area of the color correction element is formed by roughening the color correction-affected partial surface area.

9. The lighting device according to claim 1 wherein the color correction-affected partial surface area has a roughness in the μm range.

10. The lighting device according to claim 1 wherein the color correction element consists of a transparent plastic material and in that the color correction element has a wall thickness in the range from 1 mm to 5 mm.

11. A lighting device for vehicles comprising:
a semiconductor-based light source;
an optical unit having an imaging device and a color correction element, said imaging device for producing a predetermined light distribution, and said color correction element arranged between the semiconductor-based light source and the imaging device,
wherein the color correction element has a back side facing the semiconductor-based light source and has a front side facing the imaging device,
wherein the color correction element includes a transparent color correction-free partial surface area through which a firstly emitted partial light beam of the semiconductor-based light source passes, and a color correction-affected partial surface area through which a secondly emitted partial light beam of the semiconductor-based light source passes in a border angle area,
wherein the color correction-free partial surface and the color correction-affected partial surface each include an outer edge and inner edge,
wherein the inner edges of the color correction-free partial surface and the color correction-affected partial surface immediately abut one another, and
wherein the color correction-affected partial surface is less transparent than the color correction-free partial surface.

12. A lighting device for vehicles comprising:
a semiconductor-based light source;
an optical unit having an imaging device and a color correction element, said imaging device for producing a predetermined light distribution, and said color correction element arranged between the semiconductor-based light source and the imaging device,
wherein the color correction element has a back side facing the semiconductor-based light source and has a front side facing the imaging device,
wherein the front side of the color correction element and the back side of the correction element each include a transparent color correction-free partial surface area through which a firstly emitted partial light beam of the semiconductor-based light source passes, and a color correction-affected partial surface area through which a secondly emitted partial light beam of the semiconductor-based light source passes in a border angle area, and
wherein the color correction-affected partial surface is less transparent than the color correction-free partial surface.

* * * * *